US008449306B2

(12) United States Patent
An

(10) Patent No.: US 8,449,306 B2
(45) Date of Patent: May 28, 2013

(54) CONTACT TERMINAL UNIT AND SOCKET CONNECTOR INCORPORATED WITH THE SAME

(75) Inventor: Alex Lon An, Chandler, AZ (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/241,305

(22) Filed: Sep. 23, 2011

(65) Prior Publication Data

US 2013/0078865 A1 Mar. 28, 2013

(51) Int. Cl.
*H01R 9/09* (2006.01)

(52) U.S. Cl.
USPC ..... 439/70

(58) Field of Classification Search
USPC ..... 439/70, 66, 67, 71, 81, 839, 857
See application file for complete search history.

(56) References Cited

U.S. PATENT DOCUMENTS 2,346,831 A * 4/1944 Drury ..... 439/839
3,316,528 A * 4/1967 Juris et al. ..... 439/839
5,108,318 A * 4/1992 Sakurai et al. ..... 439/744
5,507,667 A * 4/1996 Hahn et al. ..... 439/501
5,730,606 A * 3/1998 Sinclair ..... 439/70
5,746,608 A * 5/1998 Taylor ..... 439/70
5,887,344 A * 3/1999 Sinclair ..... 29/843
5,984,694 A * 11/1999 Sinclair ..... 439/70
6,045,416 A * 4/2000 Sinclair ..... 439/857
6,773,285 B2 * 8/2004 Bernat et al. ..... 439/246
6,843,662 B2 * 1/2005 Ju ..... 439/83
6,955,569 B2 * 10/2005 Baker et al. ..... 439/839
7,442,045 B1 * 10/2008 Di Stefano ..... 439/66
7,467,980 B2 * 12/2008 Chiu ..... 439/843
7,537,461 B2 * 5/2009 Rathburn ..... 439/66
7,695,287 B2 * 4/2010 Smith et al. ..... 439/70
7,771,209 B2 * 8/2010 Chang ..... 439/66
7,857,631 B2 * 12/2010 Cavegn et al. ..... 439/65
8,172,581 B2 * 5/2012 Yeh ..... 439/70
8,183,155 B1 * 5/2012 Little et al. ..... 438/682

* cited by examiner

*Primary Examiner* — Alexander Gilman
(74) *Attorney, Agent, or Firm* — Wei Te Chung; Ming Chieh Chang

(57) ABSTRACT

The present invention relates to a contact terminal unit and a socket connector incorporated with the same contact terminal units. The contact terminal units each comprises a bottom piece and a top piece. The bottom pieces comprise a base portion and a number of clips extending upwardly from the base portion and the top piece is clamped by the clips such that upward movement of the top piece is limited by the bottom piece. The socket connector is incorporated with a plurality of the same contact terminal units.

20 Claims, 16 Drawing Sheets

CONTACT TERMINAL UNIT AND SOCKET CONNECTOR INCORPORATED WITH THE SAME

BACKGROUND OF THE INVENTION

1. Field of the Invention

The present invention relates to a contact terminal unit, and more particularly to a contact terminal configured with a bottom piece and a top piece clamped by the bottom piece. The present invention also includes a socket connector incorporated with the contact terminals described above.

2. Description of Prior Art

Socket connector is widely used for electrically and mechanically connecting an electronic package such as a CPU to a PCB (Printed Circuit Board) such as a motherboard. Generally, the socket connector comprises an insulative housing having a plurality of passageways, and a plurality of contact terminals received in the plurality of passageways, correspondingly.

Usually, the contact terminals are made of metal material via stamping. The contact terminal usually has a base portion with a plurality of barbs thereon. The barbs are used to penetrate into and interferentially engage with inner walls of the passageway, so as to secure the contact terminal in the corresponding passageway.

However, such conventional contact terminal brings some negative effects. Firstly, when a conventional contact terminal is inserted into the passageway, the barbs will penetrate into inner walls of the passageway. Accordingly, the housing may be warpaged and performance of the housing will be affected. Secondly, because the barbs are penetrated into the housing, the housing will be provided with a greater thickness to ensure reliable engagement between the barbs and the housing, thus making the housing and the socket connector has a greater profile and not suit for lower applications.

In view of the above, an improved contact terminal unit and a socket connector that overcomes the above-mentioned disadvantages are desired.

SUMMARY OF THE INVENTION

Accordingly, an object of the present invention is to provide a contact terminal unit and a socket connector incorporated with the same contact terminal unit, and more particularly to a contact terminal configured with a bottom piece and a top piece clamped by the bottom piece and a socket connector incorporated with the same contact terminal units thereby prevent the housing of the socket connector from damage when the contact terminal unit is assembled into the passageway of the housing.

To achieve the above-mentioned object, a contact terminal unit and a socket connector incorporated with the same contact terminal units are provided. The contact terminal units each comprises a bottom piece and a top piece. The bottom pieces comprise a base portion and a number of clips extending upwardly from the base portion and the top piece is clamped by the clips such that upward movement of the top piece is limited by the bottom piece The socket connector is incorporated with a plurality of the same contact terminal units.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Reference will now be made to the drawings to describe the present invention in detail.

Embodiment I

Referring to FIGS. 1-9, the socket connector 1 in accordance with a first embodiment of the present invention is adapted to interconnect a first electrical component (not shown) having a number of pins 2 to a second electrical component 3, e.g. PCB via solder mass 4.

Figure 1:
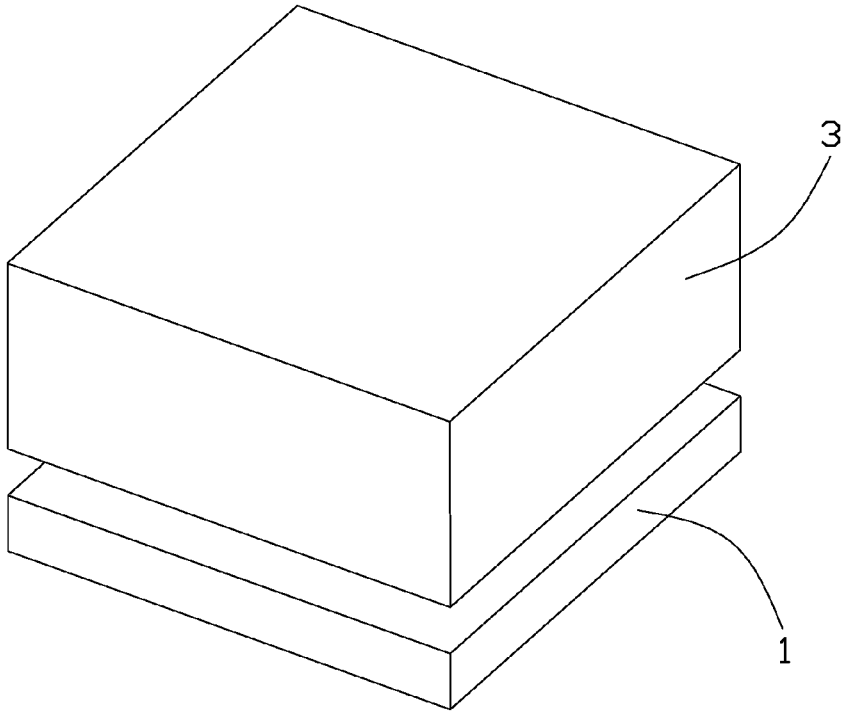
FIG. 1 is an assembled view of a socket connector mounted on a PCB in accordance with a first preferred embodiment of the present invention.
Figure 2:
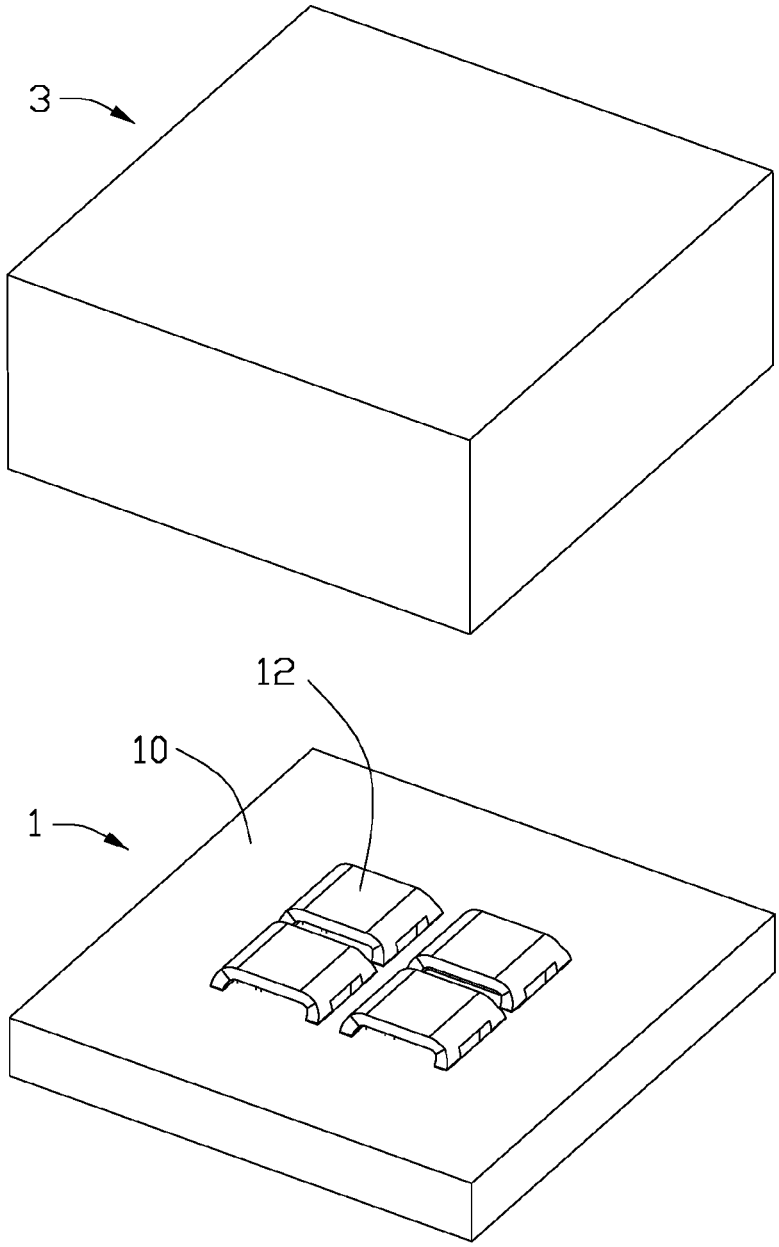
FIG. 2 is an exploded view of assembly shown in FIG. 1.
Figure 3:
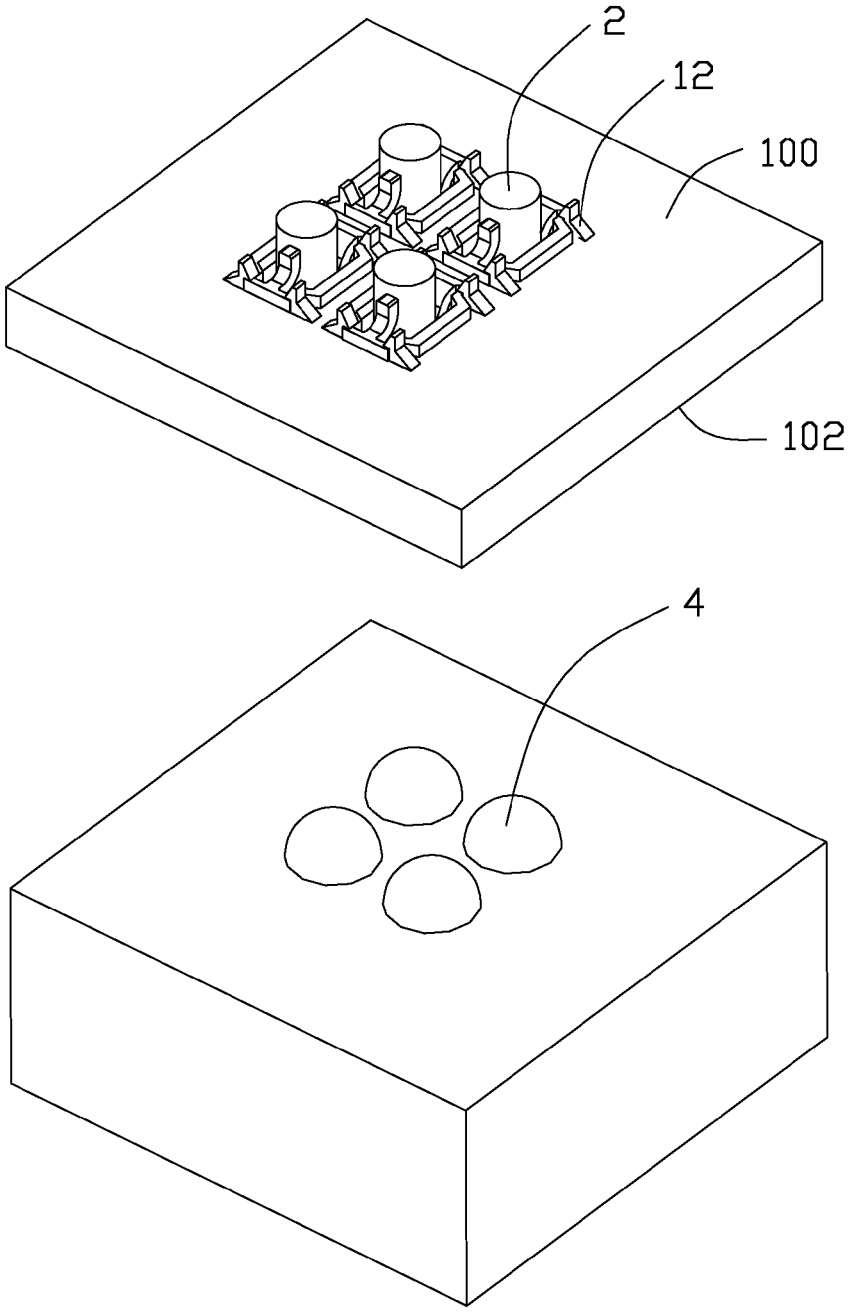
FIG. 3 is also an exploded view of the assembly shown in FIG. 1, showing the socket connector incorporated with a number of contact terminal units each engaging with a pin of a first electrical component.
Figure 4:
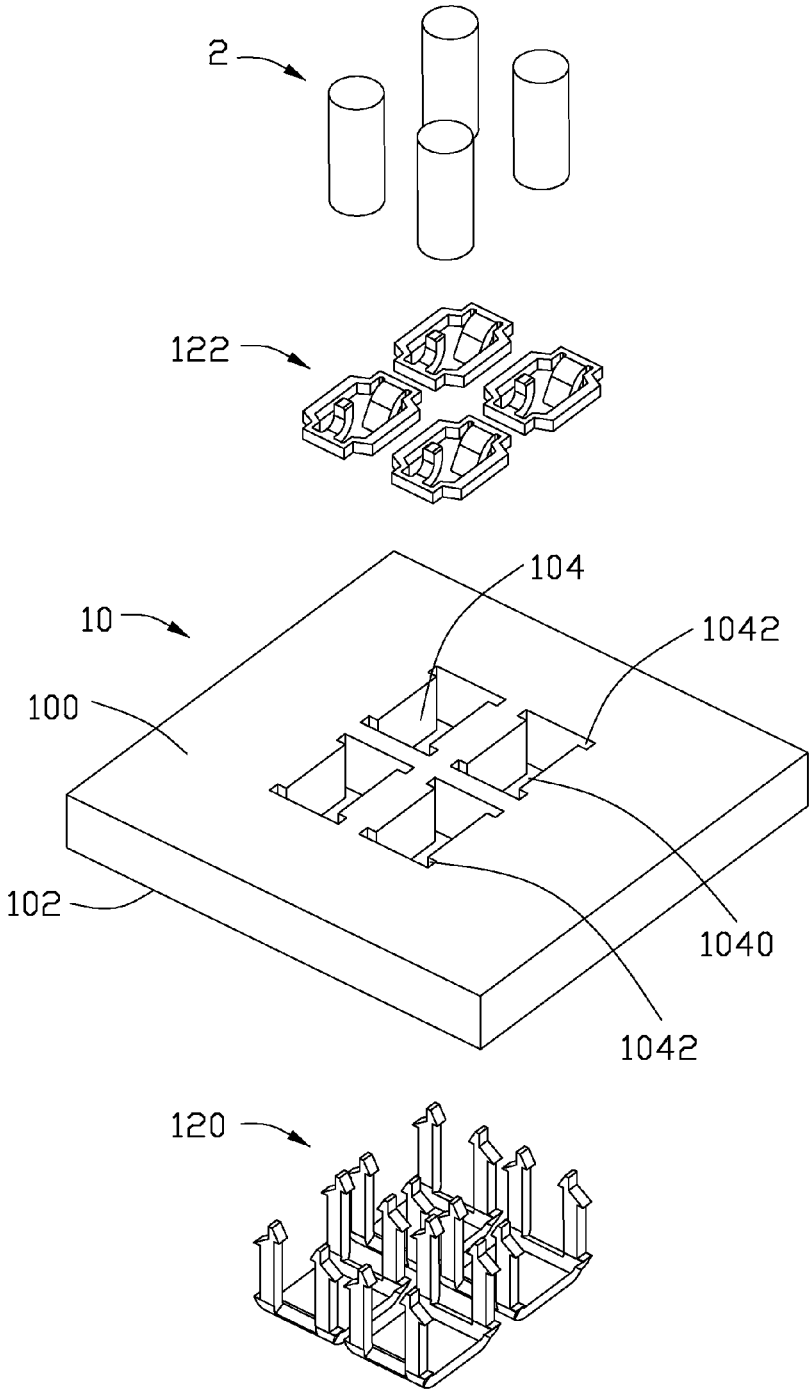
FIG. 4 is an exploded view of assemble of the socket connector incorporated with the pins shown in FIG. 3.

Referring to FIGS. 2-4, the socket connector 1 comprise a socket body 10 and a number of contact terminal units 12. The socket body 10 has an upper surface 100, a lower surface 102 opposite to the upper surface 100, and a number of passageways 104 extending to both the upper surface 100 and the lower surface 102 for receiving the number of contact terminal units 12 receptively. The passageway 104 comprises a narrow slot 1040 and two wide slots 1042 arranged at two sides of the narrow slot 1040 and communicated with the narrow slot 1040.

Figure 5:
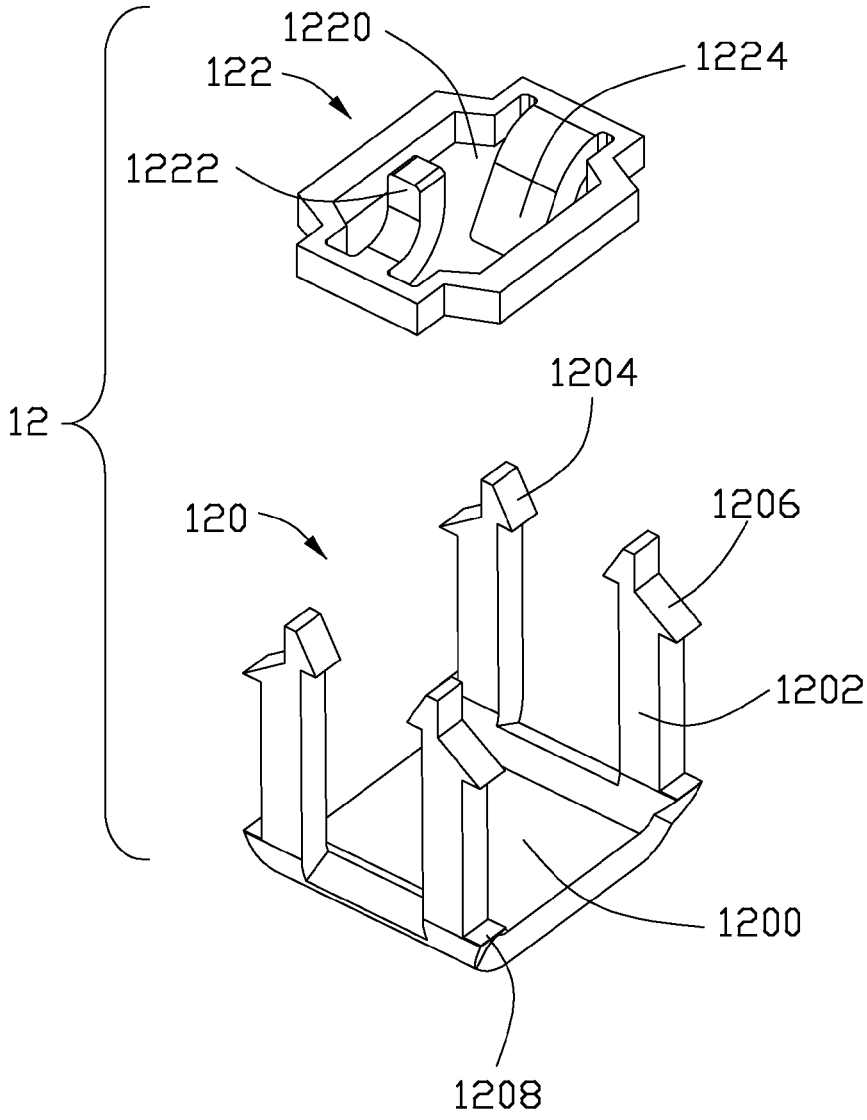
FIG. 5 is an isometric, exploded view of a contact terminal unit of the socket connector in accordance with a first preferred embodiment of the present invention shown in FIG. 3.
Figure 6:
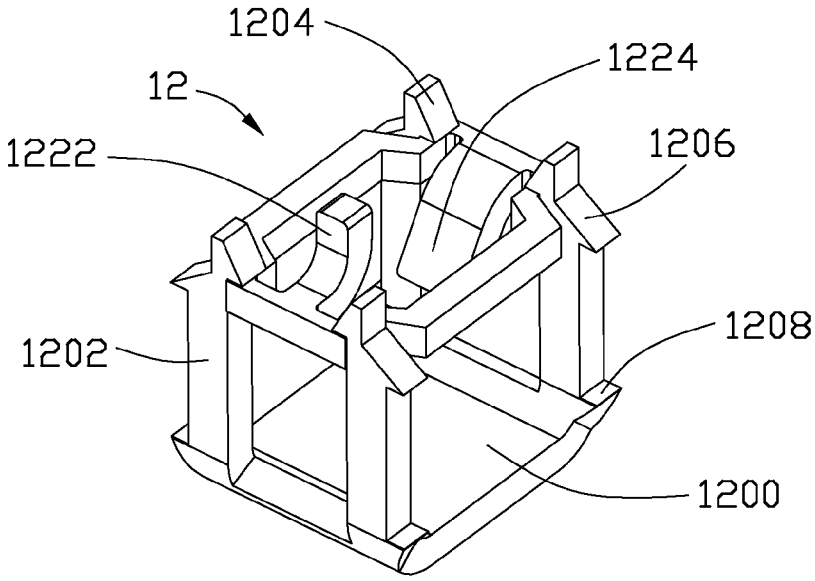
FIG. 6 is an assembled view of the contact terminal unit shown in FIG. 3.
Figure 7:
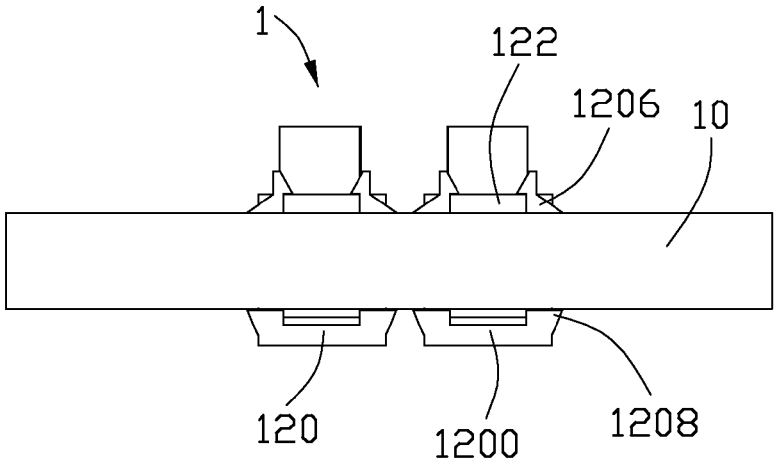
FIG. 7 is a side view of the assembly of the socket connector incorporated with the pins shown in FIG. 3.

Referring to FIGS. 4-6, the contact terminal units 12 each comprise a bottom piece 120 and a top piece 122 clamped by the bottom piece 120. The bottom piece 120 is provided with a planar base portion 1200, four clips 1202 extending upwardly from four corners of the base portion 1200 thus forming four steps 1208 at a lower end of the clips 1202 respectively. The four clips 1202 are spaced to one another. The clips 1202 each has a first latch 1204 at a top end of inner side of the clip and extending inwardly toward another clip, and a second latch 1206 at a top end of exterior side of the same clip. The top piece 122 comprises four edges which jointly define an opening 1220 therebetween. One of the edges defines an upward first arm 1222, and an opposite edge defines a downward second arm 1224. The first arm 1222 and the second arm 1224 jointly define a contacting space for engaging with the pin 2 of the first electrical component. Upward movement of the top piece 122 is limited by the first latches 1204.

Referring to FIGS. 3-9, during a process of the contact terminal unit is assembled to the socket body 10, the bottom piece 120 is inserted into the passageway 104 from the lower surface 102 of the socket body 10 and the top piece 122 is mounted on the bottom piece 120 after the bottom piece 120 is assembled with the socket body 10. The four clips 1222 are inserted into the passageway 104 along the wide slot 1042. When the bottom piece 120 is received in the passageway 104, the second latch 1206 is latched on the upper surface 100 of the socket body 10 and the steps 1208 abut against the lower surface 102 of the socket body 10. Therefore, the bottom piece 120 is secured in the passageway 104. Then, the top piece 122 is inserted into the narrow slot 1040 of the passageway 104 until it is clamped by the clips 1202 of the bottom piece 120. Accordingly, the contact terminal unit 12 is assembled with the socket body 10.

Figure 8:
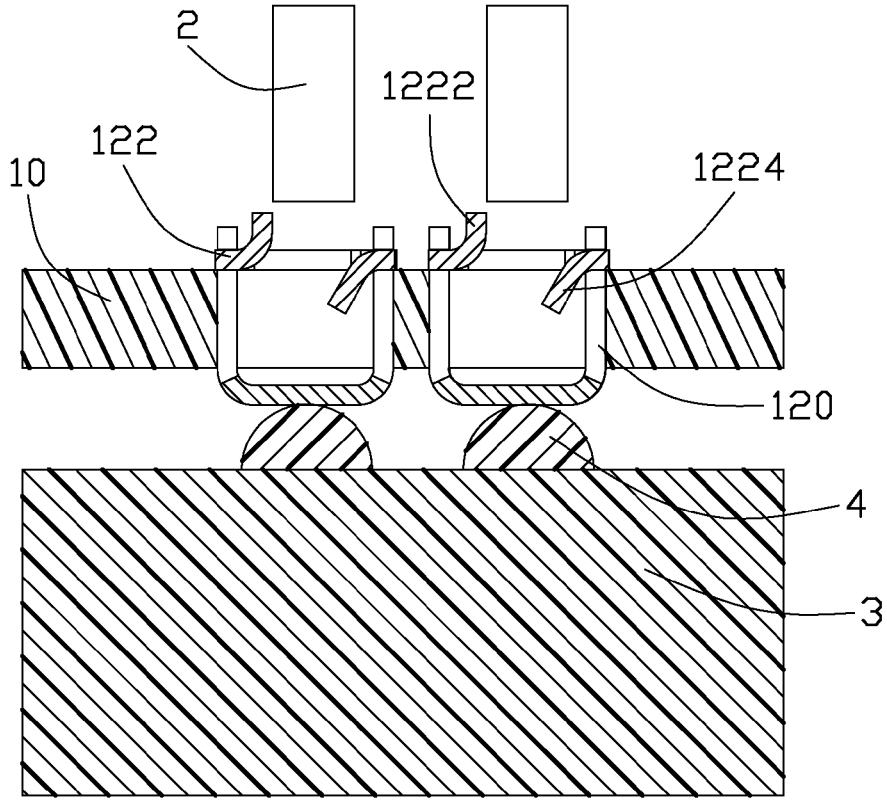
FIG. 8 is a cross-sectional view of the socket connector in accordance with the first preferred embodiment of the present invention, showing the pin of the electrical component being ready to be inserted into passageway of the socket connector and engaged with the contact terminal unit.
Figure 9:
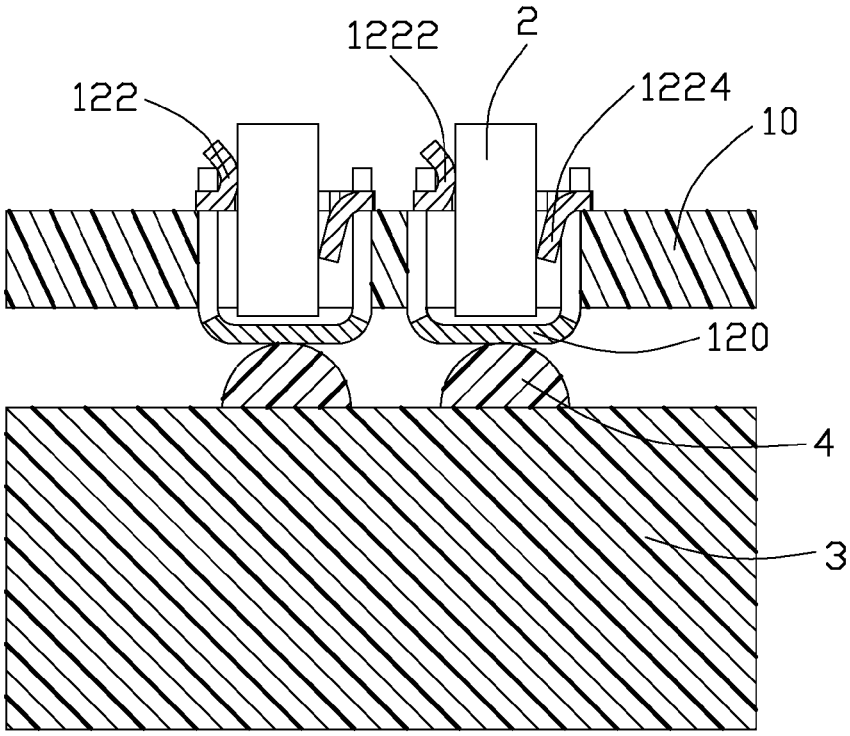
FIG. 9 is similar to FIG. 8, showing the pin being received in the passageway and engaged with the contact terminal unit.
Figure 10:
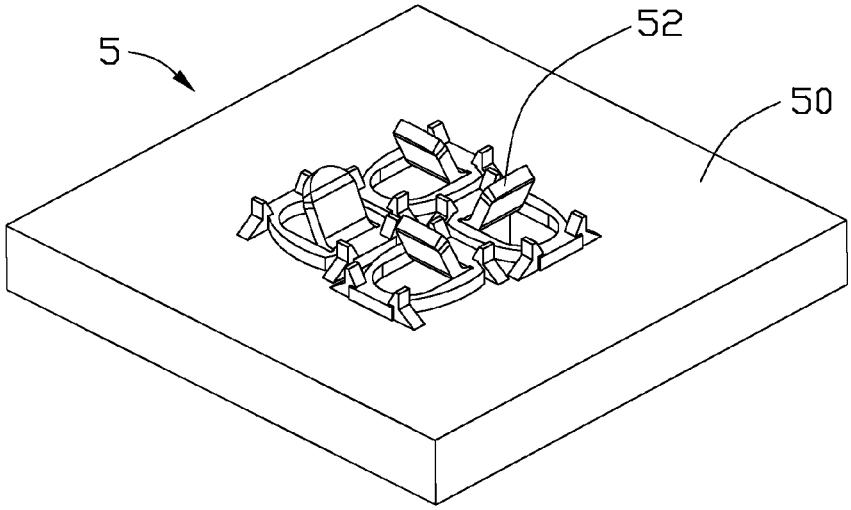
FIG. 10 is an assembled view of a socket connector in accordance with a second preferred embodiment of the present invention.

Referring to FIGS. 8-9, the bottom piece 120 is soldered to the second electrical component 3 by solder mass 4. The pin 2 will be inserted into the contacting space defined by the first arm 1222 and the second arm 1224. The first arm 1222 and the second arm 1224 will exert elastic deformation and will tightly engage with the pin 2. Therefore, electrical connection between the pin 2 and the second component 3 is established.

Embodiment II

Figure 11:
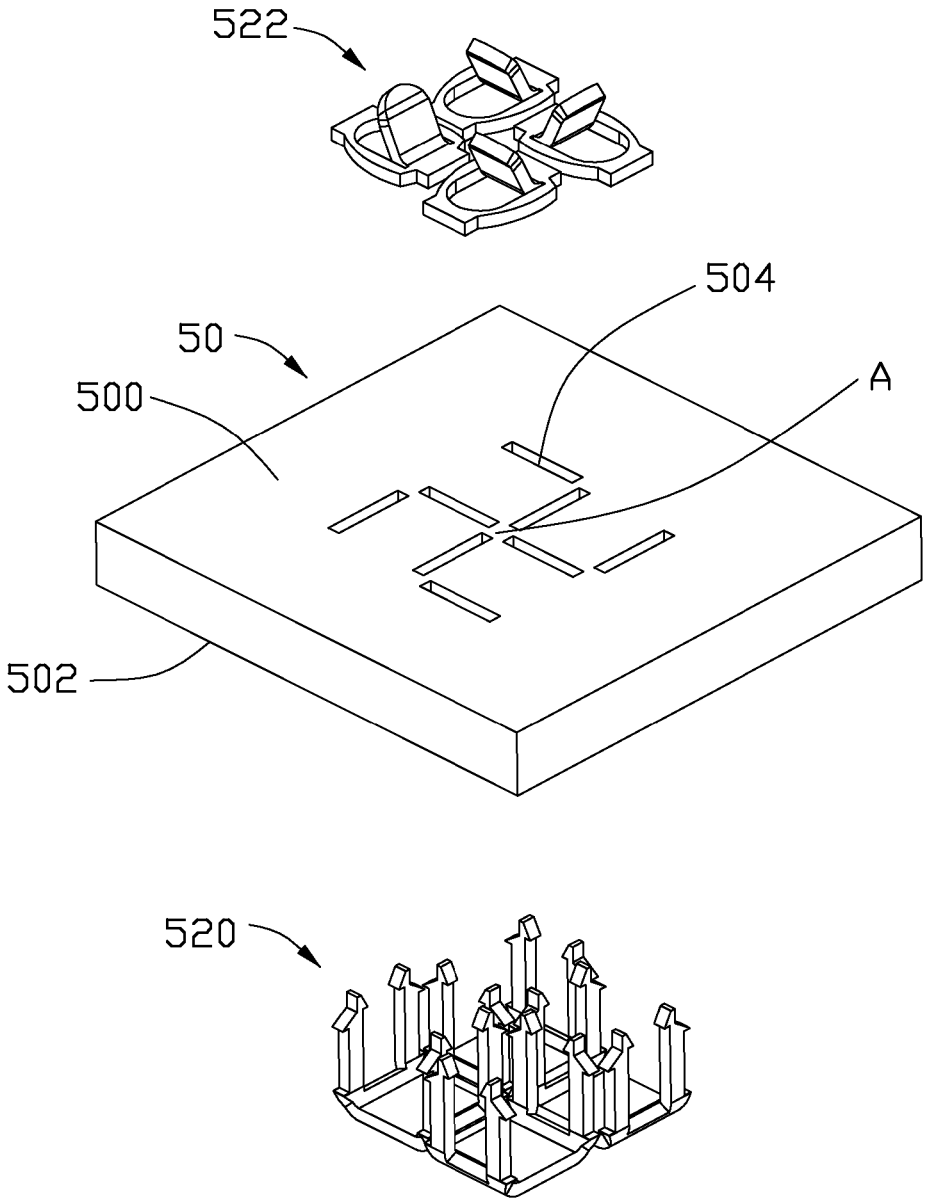
FIG. 11 is an exploded view of the socket connector shown in FIG. 10.

Referring to FIGS. 10-15, the socket connector 5 in accordance with a second embodiment of the present invention is shown. The socket connector 5 is also comprising a socket body 50, and a number of contact terminal units 52. The socket body 50 has an upper surface 500, a lower surface 502 opposite to the upper surface 500, and a number of passageways extending through the upper surface 500 and the lower surface 502 for receiving the number of contact terminal units 52 receptively. The passageways each comprises a pair of slits 504 spaced to each other and not communicated with each other. In other words, two opposite slits 504 are used for receiving a same contact terminal unit 52 and formed as a group of slits. As shown in FIG. 11, in the second embodiment, the socket body 50 has four group of slits are disposed around a central point A and rotated along the clockwise/counter-clockwise direction around the central point A. Two slits 504 of a same group are parallel to each other.

Figure 12:
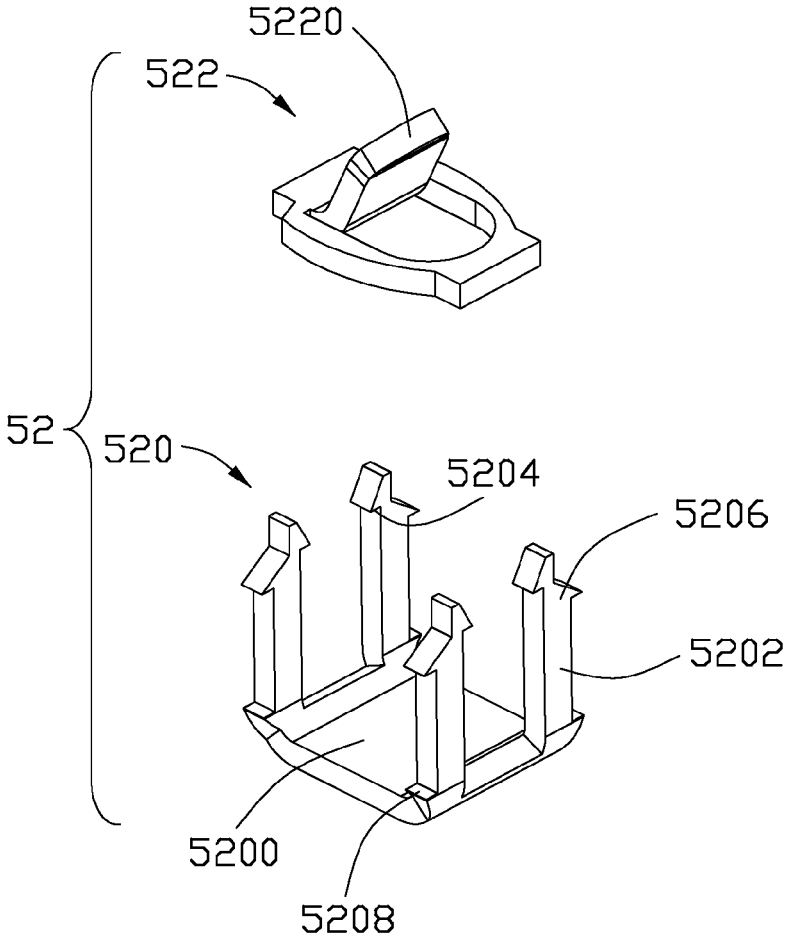
FIG. 12 is an exploded view of a contact terminal unit of the socket connector in accordance with the second preferred embodiment of the present invention.
Figure 13:
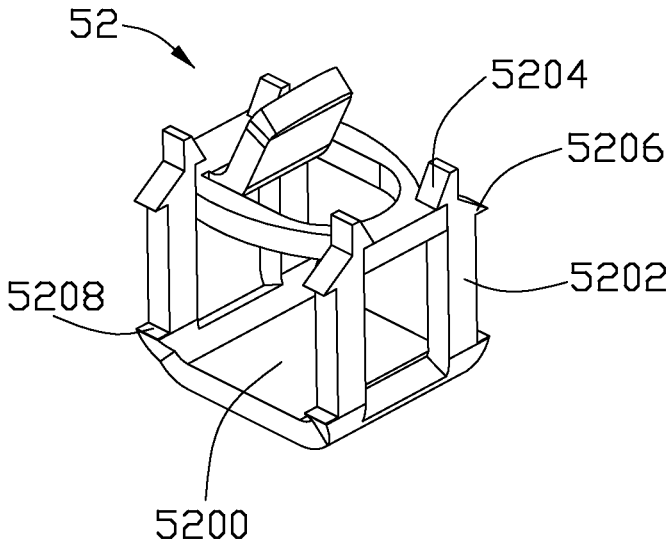
FIG. 13 is an assembled view of the contact terminal unit of the socket connector shown in FIG. 12.
Figure 14:
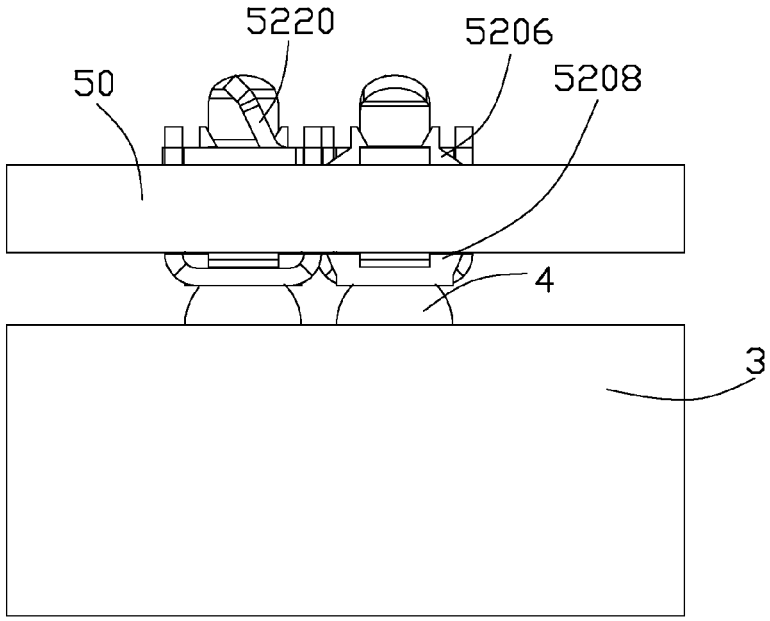
FIG. 14 is a side, assembled view of the socket connector, further showing a PCB connected with the socket connector by solder mass.

Referring to FIGS. 12-13, the contact terminal unit 52 comprises a bottom piece 520 and a top piece 522. The bottom piece 520 of the second embodiment has a same structure as the bottom piece 120 of the first embodiment. The bottom piece 520 comprise a base portion 5200 and four clips 5202. The clips 5202 each comprises a first latch 5204, a second latch 5206 and a step 5208. The top piece 522 is different to the top piece 122 of the first embodiment. The top piece 522 has only an upward spring arm 5220, which is split from main portion of the top piece 522.

Referring to FIGS. 11-15, when the contact terminal 52 is assembled to the socket body 50, the bottom piece 520 is mounted to the socket body 50 from the lower surface 502 of the socket body 50 and the top piece 522 is assembled to the socket body 50 from the upper surface 500. The first latch 5204 is provided with a slant surface so as to ensure the clip 5202 of the bottom piece 500 to be inserted into the slit 504 easily. The four clips 5202 of a same bottom piece 520 of a contact terminal unit 52 are received in a same of group slits. Two slits 504 of a same group of slits each has two clips 5202 received therein. The second latches 5206 abut against the upper surface 500 while the steps 5208 abut against the bottom surface 502. Accordingly, the bottom piece 520 is secured by the socket body 50. The top piece 522 is located on the upper surface 500 of the socket body 50 and clamped by the four clips 5202 of the bottom piece 500. Additionally, the first latches 5204 are clipping on the top end of the bottom piece 502 so as to limit upward movement of the top piece 500.

Figure 15:
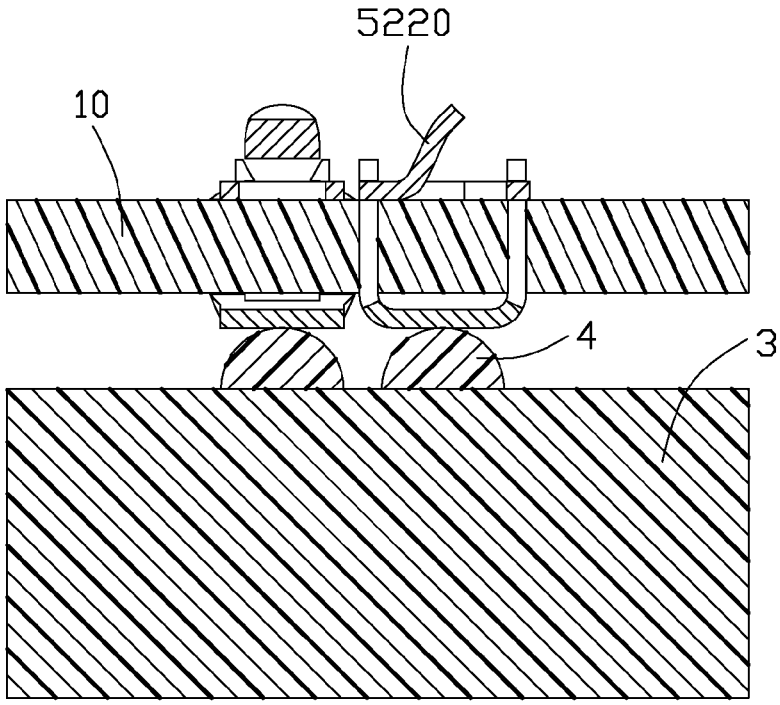
FIG. 15 is a cross-sectional view of assembly shown in FIG. 14.
Figure 16:
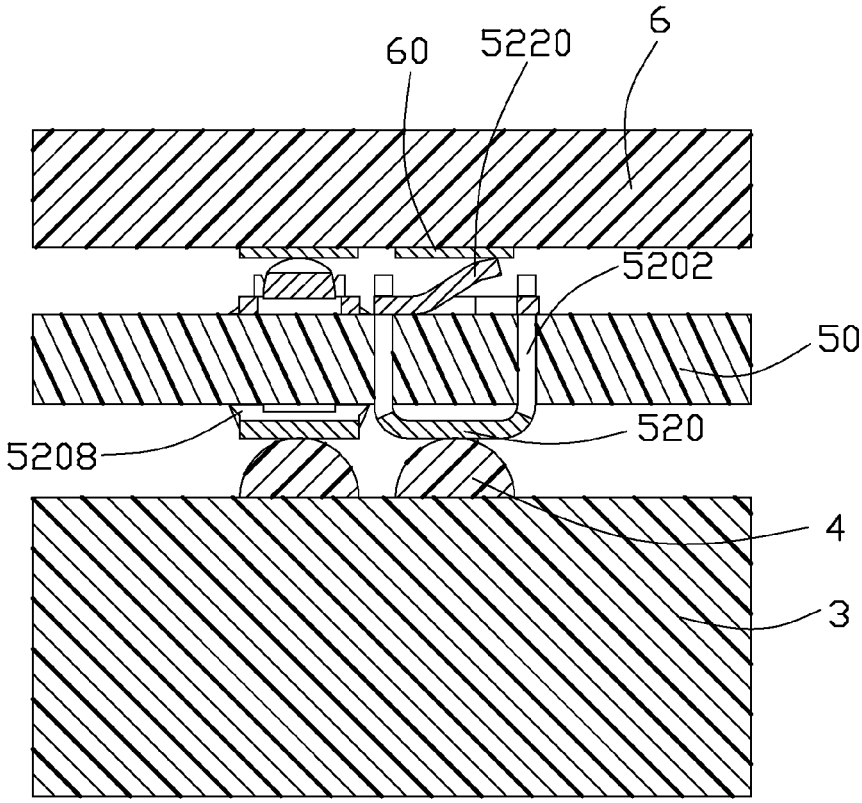
FIG. 16 is similar to the FIG. 15, showing an LGA module mounted on the socket connector and contacting with the contact terminal units.

Referring to FIGS. 15-16, because the top piece 522 has a spring arm 5220 extending upwardly and forwardly, the contact terminal unit 52 can connect a LGA module 6 having pads 60 on a bottom face thereof to a PCB 3. As the first embodiment, the bottom piece 502 is soldered to a second electrical component 3 by solder mass 4.

While the preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical contact terminal unit for interconnecting two electronic components, comprising:

a bottom piece comprising a base portion and a number of clips extending upwardly from the base portion; and a top piece assembled to the bottom piece with its upward movement limited by those clips; wherein the clips each has a first latch at a top end of the inner side of the clip to clamp with the top piece and a second latch disposed at a top end of exterior side of the clip.

2. The electrical contact terminal unit as claimed in claim 1, wherein the clips extend upwardly from four corners of the base portion, thus forming four steps at a lower end of the clips respectively.

3. The electrical contact terminal unit as claimed in claim 1, wherein the top piece defines an opening therethrough.

4. The electrical contact terminal unit as claimed in claim 3, wherein the opening is formed with a first edge and a second edge opposite to the first edge, wherein the first edge defines a first arm while the second edge defines a second arm, the first arm and second arm jointly defining a contacting space for engaging with a pin of an electrical component.

5. The electrical contact terminal unit as claimed in claim 4, wherein the first arm extends upwardly and the second arm extends downwardly.

6. The electrical connector assembly as claimed in claim 1, wherein the top piece has only an upward spring arm, which is split from main portion of the top piece.

7. A socket connector for interconnecting two electronic components, comprising:

a socket body, having an upper surface, a lower surface and a number of passageways extending through the upper surface and lower surface;

a plurality of contact terminal units received in the passageways, respectively, each contact terminal comprising:

a bottom piece comprising a base portion and a number of clips extending upwardly from the base portion; and a top piece assembled to the bottom piece, and upward movement of the top piece being limited by the clips; downward movement of the top piece being limited by the socket body; wherein the clips each has a second latch disposed at a top end of exterior side of the clip; wherein the clips extend upwardly from four corners of the base portion, thus forming four steps at a lower end of the clips respectively.

8. The electrical contact terminal unit as claimed in claim 7, wherein the clips each has a first latch at a top end of inner side of the clip and extending inwardly toward another clip.

9. The electrical contact terminal unit as claimed in claim 7, wherein the second latches abut against the upper surface of the socket body and the steps abut against the lower surface of the socket body.

10. The electrical contact terminal unit as claimed in claim 7, wherein the top piece defines an opening with a first edge, and a second edge opposite to the first edge, wherein the first edge defines a first arm while the second edge defines a second arm, the first arm and second jointly defining a contacting space for engaging with a pin of an electrical component.

11. The electrical contact terminal unit as claimed in claim 10, wherein the first arm extends upwardly and the second arm extends downwardly.

12. The electrical contact terminal unit as claimed in claim 7, wherein the passageway comprises a narrow slot and two wide slots arranged at two sides of the narrow slot and communicated with the narrow slot.

13. The electrical contact terminal unit as claimed in claim 7, wherein the passageway comprises a number of groups of slits, and each group of slots comprising two slits spaced to each other.

14. The electrical connector assembly as claimed in claim 7, wherein the top piece has only an upward spring arm, which is split from main portion of the top piece.

15. An electrical connector assembly comprising:

an insulative housing defining opposite upper and bottom surfaces in a vertical direction;

a plurality of passageways extending through the housing in the vertical direction;

a plurality of contacts disposed in the corresponding passageways, respectively, each of said contacts including a bottom piece equipped with an upward abutment face at a lower level to abut against the housing for restrain upward movement thereof, and with a downward abutment face at an upper level, and a top piece sandwiched between the downward abutment face and the housing; wherein a contact arm unitarily extends from the top piece for contacting a lead of an electronic component located above the upper surface.

16. The electrical connector assembly as claimed in claim 15, wherein the top piece is essentially located upon the upper surface.

17. The electrical connector assembly as claimed in claim 15, wherein the bottom piece defines a plurality of resilient clips to grasp the top piece in position.

18. The electrical connector assembly as claimed in claim 17, wherein said clips further downwardly abut against the housing.

19. The electrical connector assembly as claimed in claim 15, wherein said contact arm extends upwardly above the upper surface of the housing for resiliently contacting the lead of the electronic component.

20. The electrical connector assembly as claimed in claim 15, wherein said contact arm extends downwardly into the passageway for resiliently contacting the lead of the electronic component.

* * * * *